US011624257B1

(12) United States Patent
Allumbaugh

(10) Patent No.: US 11,624,257 B1
(45) Date of Patent: Apr. 11, 2023

(54) MODULAR DOWNHOLE PLUG TOOL

(71) Applicant: LEVEL 3 SYSTEMS, LLC, Cedar Park, TX (US)

(72) Inventor: Michael S. Allumbaugh, Laredo, TX (US)

(73) Assignee: LEVEL 3 SYSTEMS, LLC, Cedar Park, TX (US)

( * ) Notice: Subject to any disclaimer, the term of this patent is extended or adjusted under 35 U.S.C. 154(b) by 0 days.

(21) Appl. No.: 17/852,655

(22) Filed: Jul. 11, 2022

Related U.S. Application Data

(63) Continuation of application No. 17/676,377, filed on Feb. 21, 2022, now Pat. No. 11,448,035.

(51) Int. Cl.
*E21B 33/13* (2006.01)
*E21B 33/12* (2006.01)

(52) U.S. Cl.
CPC ..... *E21B 33/13* (2013.01); *E21B 33/1208* (2013.01)

(58) Field of Classification Search
CPC ..... E21B 33/13; E21B 33/1208
See application file for complete search history.

(56) References Cited

U.S. PATENT DOCUMENTS 2,762,441 A 9/1956 Newlin
3,289,766 A 12/1966 Bigelow
3,457,992 A * 7/1969 Brown ..... E21B 33/043 166/88.1
4,494,608 A * 1/1985 Williams ..... E21B 23/08 166/322
4,627,488 A * 12/1986 Szarka ..... E21B 43/04 166/278
4,969,515 A 11/1990 Dollison
5,909,769 A * 6/1999 Duhon ..... E21B 33/12 166/135
10,428,616 B2 * 10/2019 Dirocco ..... E21B 33/1204
10,626,697 B2 * 4/2020 Dirocco ..... E21B 33/134
2008/0023193 A1 * 1/2008 O'Brien ..... E21B 33/1277 166/179
2011/0259610 A1 10/2011 Shkurti et al.
2013/0213671 A1 * 8/2013 Reimert ..... E21B 33/035 166/75.13
2014/0332239 A1 11/2014 Porta
2015/0300121 A1 * 10/2015 Xu ..... E21B 33/134 166/118
2018/0363407 A1 * 12/2018 Kunz ..... E21B 33/128
2019/0323315 A1 * 10/2019 Kennedy ..... E21B 33/134
2020/0072008 A1 * 3/2020 Dirocco ..... E21B 33/10
2020/0240233 A1 * 7/2020 Chenault ..... E21B 33/1208
2021/0017833 A1 * 1/2021 Saraya ..... E21B 33/1208
2021/0301620 A1 * 9/2021 Tonti ..... E21B 33/1212
2021/0317721 A1 * 10/2021 Santoso ..... E21B 33/1208

* cited by examiner

*Primary Examiner* — Steven A Macdonald
(74) *Attorney, Agent, or Firm* — Dickinson Wright PLLC; Michael E. Noe; Stephen A. Mason

(57) ABSTRACT

A pressure-isolation device has a plug for isolating pressure within a wellbore. The plug can include one or more modular mandrel assemblies partially disposed within each other. Each mandrel assembly can include a sealing element and a shear pin for setting the mandrel section. Each mandrel assembly can also have a collar element, a shear sleeve, a mandrel stop element, and a back-up ring in contact with the sealing element. The plug can further include a bottom receiving element including a knockout plug. The plug assembly can include a top catch element for setting and pulling the plug.

18 Claims, 9 Drawing Sheets

MODULAR DOWNHOLE PLUG TOOL

CROSS REFERENCE TO RELATED APPLICATION

This United States patent application is a continuation of, and claims priority under 35 U.S.C. § 120 to, U.S. patent application Ser. No. 17/676,377, filed on Feb. 21, 2022. The disclosure of this prior application is considered part of the disclosure of this application and is hereby incorporated by reference in its entirety.

BACKGROUND

Embodiments of the present invention described herein relate generally to pressure isolation devices. Particularly, some embodiments relate to wellbore plug assemblies or tools. Wellbore packers and similar tools are typically deployed in oil or gas wells to isolate well sections from gas, fluid, or both.

Sealing is typically accomplished at the wellbore wall using cylindrical elements made of rubber or another malleable material. Metal rings are sometimes employed on one or both sides of the malleable element to reduce or prevent extrusion of the malleable element, particularly in high-pressure applications.

Typical slickline plug assemblies provide a single seal or barrier at relatively low pressures. Some multi-barrier tools capable of holding extremely high pressures (e.g., 10,000 p.s.i. or more) are available, but such tools typically require expensive electric line ("e-line") equipment and crews to deploy, and also may require a separate slickline crew to remove. Such applications may be cost-prohibitive in many situations, consuming as much at 60% additional manpower in addition to greater up-front costs for equipment.

SUMMARY

Embodiments of a device can include a main body having a top end and a bottom end along a longitudinal axis. The main body can include a first diameter adjacent the top end, a second diameter adjacent the bottom end. The device includes a receiving body receiving a portion of the main body. The device further includes a plurality of coupling elements disposed radially between the main body and the receiving body. In addition, the portion of the main body disposed within the receiving body is radially and fully enclosed with the plurality of coupling elements.

In accordance with a further aspect of the present disclosure, the plurality of coupling elements include at least one collar element and at least one shear sleeve, disposed radially between the main body and the receiving body. Further, at least one sealing element, the at least one collar element, and the at least one shear sleeve are radially disposed about the main body and each arranged in an order along the longitudinal axis.

Embodiments of a device can includes a bottom receiving body, a first mandrel assembly, and a second mandrel assembly. The first mandrel assembly includes a first main body having a top end and a bottom end, and a plurality of coupling elements disposed radially between the first main body and the bottom receiving body. The first main body is partially disposed within the bottom receiving body and a portion of the first main body disposed within the bottom receiving body is fully enclosed with the plurality of first coupling elements. Further, the second mandrel assembly includes a second main body having a top end and a bottom end, and a plurality of second coupling elements disposed radially between the first main body and the second main body. The second main body is partially disposed within the first main body and a portion of the second main body disposed within the first main body is fully enclosed with the plurality of second coupling elements.

A method includes the steps of selecting at least two shear pins according to a desired order of engagement of at least two mandrels, assembling a plug assembly, deploying the plug assembly into a wellbore, and applying pressure continuously until each of the shear pins coupled to each of the mandrels shear. Further, the plug assembly includes the at least two mandrels positioned from a top to a bottom of the plug assembly along a longitudinal axis and a bottom receiving body. Each mandrel comprises one of the shear pins and a sealing element, and one of the mandrels arranged in a higher position than the other mandrel along the longitudinal axis is at least partially disposed within the other mandrel. One of the mandrels arranged in the bottom is at least partially disposed within the bottom receiving body.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

FIG. 1A depicts an example dual-barrier plug assembly deployed within a well casing according to some embodiments. FIG. 1B shows a top view of the plug tool assembly of FIG. 1A. FIG. 1C is an exploded view of components of the plug tool assembly of FIG. 1A.

FIG. 2A shows an orthographic external view of an example main body. FIG. 2B depicts a cross-section view of the example main body of FIG. 2A. FIG. 2C depicts an isometric external view of the example main body of FIG. 2A.

FIG. 3A shows an orthographic view of an example shear sleeve according to some embodiments. FIG. 3B shows a top view of the example shear sleeve of FIG. 3A. FIG. 3C depicts an isometric external view of the example shear sleeve of FIG. 3A.

FIG. 4A shows an orthographic external view of an example collar element according to some embodiments. FIG. 4B shows a cross-sectional view of the example collar element of FIG. 4A. FIG. 4C depicts an isometric external view of the example collar element of FIG. 4A.

FIG. 5A shows an orthographic view of an example mandrel stop element according to some embodiments. FIG. 5B shows a top view of the example mandrel stop element of FIG. 5A. FIG. 5C depicts an isometric external view of the example mandrel stop element of FIG. 5A.

FIG. 6A shows an orthographic external view of an example bottom receiving element according to some embodiments, including a cutaway to depict additional detail related to a knockout plug element. FIG. 6B shows a cross-sectional view of the of the example bottom receiving element of FIG. 6A. FIG. 6C shows an orthographic external view of the example bottom receiving element of FIG. 6A. FIG. 6D depicts an isometric external view of the example bottom receiving element of FIG. 6A.

FIG. 7A shows an orthographic external view of an example top catch body according to some embodiments. FIG. 7B shows a cross-sectional view of the example top catch body of FIG. 7A. FIG. 7C depicts and isometric external view of the example top catch body of FIG. 7A.

DETAILED DESCRIPTION

Overview

A modular wellbore or tubing plug allows for one or more sealing barriers according to the user's choice, and can be deployed or placed, for example, in any no-go, tubing, or collar stop at any depth in a wellbore.

A plug tool assembly can be set and retrieved using standard slickline equipment, without the need for expensive e-line equipment or crews. However, the unique design of the plug, particularly in dual-barrier or greater configurations, exceeds typical slickline-deployed plugs.

The modular plug tool can use cylindrical sealing elements made of rubber or a similarly malleable material, where the sealing element is deployed around a mandrel which pushes down into the sealing element, causing pressure between the sealing element and wellbore wall, thus creating a seal impermeable to gas or fluid.

Shear pins made of various materials having differing shear strengths can be employed as a means of controlling the order of engagement of sealing elements in a multi-barrier configuration of the modular plug tool.

The modular plug can be equipped with a knockout plug for equalizing pressure differentials before retrieving the tool. An exemplary knockout plug can be a standard Kobe knockout or other similarly suitable knockout plug.

Materials used to construct non-malleable parts of the plug tool may be any pure, composite, or alloy material capable of holding high pressures and suitable for the wellbore environment. For example, an example device according to the present invention may utilize heat-treated 4140 steel as its primary material. An exemplary hardness requirement for such steel may be 45-48 HRC minimum.

Illustrative Devices

Figure 1A:
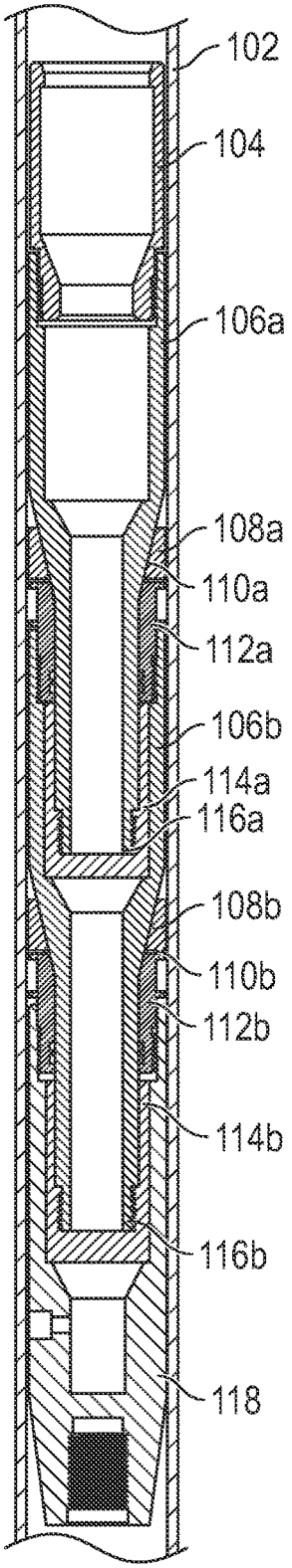
FIGS. 1A, 1B, and 1C show several views of an example plug assembly according to some embodiments.
Figure 1B:
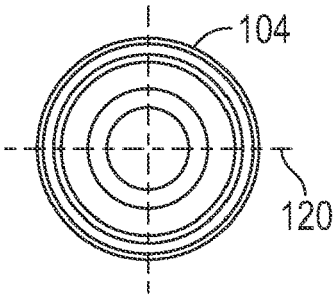
Figure 1C:
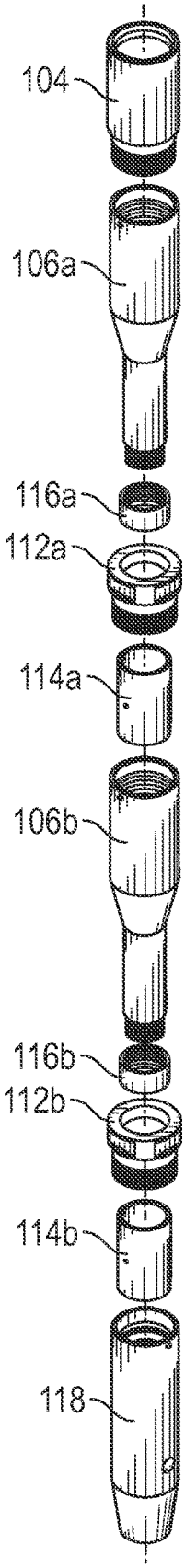

FIGS. 1A-C depict several views of an example plug assembly according to some embodiments. At FIG. 1A, an example dual-barrier plug assembly according to some embodiments of the present invention is deployed within casing 102. Casing 102 according to some embodiments can be a wellbore casing.

Top catch element 104 can be a standard "fish neck," "fishing neck," or top catch element. Top catch element 104 can typically be removed by standard wellbore plug removal equipment. In some embodiments, top catch element 104 is coupled to a main body or first mandrel 106*a*. For example, in some embodiments, top catch element 104 can be partially disposed within first mandrel 106*a* and securely coupled to first mandrel 106*a* via buttress threads.

First mandrel 106*a*, according to some embodiments, comprises two cylindrical sections of differing external diameters, the cylindrical sections having an externally tapered section between them. Similarly inside, first mandrel 106*a* according to some embodiments can have two sections of different internal cylindrical diameter, the sections connected by an internal tapered section.

A first sealing element 108*a* can be disposed about first mandrel 106*a*. For example, example first sealing element 108*a* can be disposed about the external tapered section of first mandrel 106*a*, about the narrower external cylindrical section of first mandrel 106*a*, or both. The example first sealing element 108*a* can be constructed of one or more malleable materials capable of forming a seal with a wellbore wall. For example, example first sealing element 108*a* may be made of any suitable type of rubber or other elastomers, or a combination thereof, or any similar material known or available to one of ordinary skill in the relevant art.

An example optional first back-up ring 110*a* can be used on one or both sides of first sealing element 108*a* in order to reduce or prevent extrusion of first sealing element 108*a* along the longitudinal axis of the example plug tool assembly. An example optional back-up ring can be constructed of any hard metal, alloy, or other suitable material as would be apparent to one of ordinary skill in the art.

An example first collar element 112*a* (also called a seal catch) can be disposed about first mandrel 106*a*. For example, first collar element 112*a* can be disposed about the section of first mandrel 106*a* having the narrower external diameter. According to the example embodiment of FIG. 1A, first collar element 112*a* can be coupled to a second mandrel element 106*b*, for example being secured by buttress threading.

When an example plug tool assembly according to FIG. 1A is fully deployed (i.e., all shear pins have broken and seals have been formed with the wellbore wall), pressure can be exerted between first collar element 112*a* and first sealing element 108*a*, for example directly or via first back-up ring 110*a* according to the specific configuration.

First shear sleeve 114*a* can be partially or completely disposed within second mandrel 106*b*. For example, when an example plug tool assembly according to FIG. 1A is fully deployed, first shear sleeve 114*a* is completely disposed within second mandrel 106*b*, as illustrated in FIG. 1A. First mandrel 106*a* can be partially disposed within first shear sleeve 114*a*.

In some embodiments, first shear catch 116*a* (also called a mandrel stop element) can be coupled to the bottom end of first mandrel 106*a*, as illustrated in FIG. 1A. Before a first shear pin is broken (not shown), first shear catch 116*a* according to some embodiments can engage directly with the first shear pin, transmitting force to the shear pin until the first shear pin breaks and falls down into the central cavity of the example plug tool assembly.

In other embodiments, a bottom portion of first mandrel 106*a* may engage directly with the shear pin and otherwise serve the functions of first shear catch 116*a*.

A second sealing element 108*b* can be disposed about second mandrel 106*b*. For example, second sealing element 108*b* can be disposed about the external tapered section of second mandrel 106*b*, about the narrower external cylindrical section of second mandrel 106*b*, or both. The example second sealing element 108*b* can be constructed of one or more malleable materials capable of forming a seal with a wellbore wall. For example, second sealing element 108*b* may be made of any suitable type of rubber or other elastomers, or a combination thereof, or any similar material known or available to one of ordinary skill in the relevant art.

An example optional second back-up ring 110*b* can be used on one or both sides of second sealing element 108*b* in order to reduce or prevent extrusion of second sealing element 108*b* along the longitudinal axis of the example plug tool assembly. An example optional back-up ring can be constructed of any hard metal, alloy, or other suitable material as would be apparent to one of ordinary skill in the art.

An example second collar element 112*b* (also called a seal catch) can be disposed about second mandrel 106*b*. For example, second collar element 112*b* can be disposed about the section of second mandrel 106*b* having the narrower external diameter. According to the example embodiment of FIG. 1A, second collar element 112*b* can be coupled to a second mandrel element 106*b*, for example being secured by buttress threading.

When an example plug tool assembly according to FIG. 1A is fully deployed (i.e., all shear pins have broken and seals have been formed with the wellbore wall), pressure can be exerted between second collar element 112*b* and second sealing element 108*b*, for example directly or via second back-up ring 110*b* according to the specific configuration.

Second shear sleeve 114*b* can be partially or completely disposed within bottom receiving unit 118. For example, when an example plug tool assembly according to FIG. 1A is fully deployed, second shear sleeve 114*b* is completely disposed within bottom receiving unit 118, as illustrated in FIG. 1A. Second mandrel 106*b* can be partially disposed within second shear sleeve 114*b*.

In some embodiments, second shear catch 116*b* (also called a mandrel stop element) can be coupled to the bottom end of second mandrel 106*b*, as illustrated in FIG. 1A. Before a second shear pin is broken (not shown in FIG. 1A), second shear catch 116*b* according to some embodiments can engage directly with the second shear pin, transmitting force to the shear pin until the first shear pin breaks and falls down into the central cavity of the example plug tool assembly.

In other embodiments, a bottom portion of second mandrel 106*b* may engage directly with the shear pin and otherwise serve the functions of second shear catch 116*b* of FIG. 1A.

FIG. 1B shows a top view of the plug tool assembly of FIG. 1A and demonstrates the axis 120, across which the cross-section of FIG. 1A is taken. Wellbore casing 102 is not shown at FIG. 1B. Instead the outside ring represents top catch element 104.

FIG. 1C shows the disassembled components of the example plug tool assembly of FIG. 1A, with the exception that sealing elements 108 and back-up rings 110 are now shown in FIG. 1C. The layout of FIG. 1C shows an illustrative order of assembly of the example plug tool of FIG. 1A.

At FIG. 1C, second shear sleeve 114*b* can be disposed within bottom receiving unit 118. Second collar element 112*b* can be partially disposed within bottom unit 118. Second collar element 112*b* can further be coupled to bottom unit 118.

According to some embodiments, second shear catch 116*b* can be coupled to second mandrel 106*b*, and the resulting assembly can in turn be partially disposed within second shear sleeve 114*b* and bottom unit 118.

First shear sleeve 114*a* can be disposed within second mandrel 106*b*. First collar element 112*a* can be partially disposed within second mandrel 106*b*. First collar element 112*a* can further be coupled to second mandrel 106*b*.

According to some embodiments, second shear catch 116*a* can be coupled to first mandrel 106*a*, and the resulting assembly can in turn be partially disposed within first shear sleeve 114*a* and second mandrel 106*b*.

Top catch body 104 also can be coupled to first mandrel 106*a*, completing the example assembly in FIG. 1C of an example plug tool assembly.

Various parts of the example plug tool assembly are described in further detail in the paragraphs below.

Figure 2A:
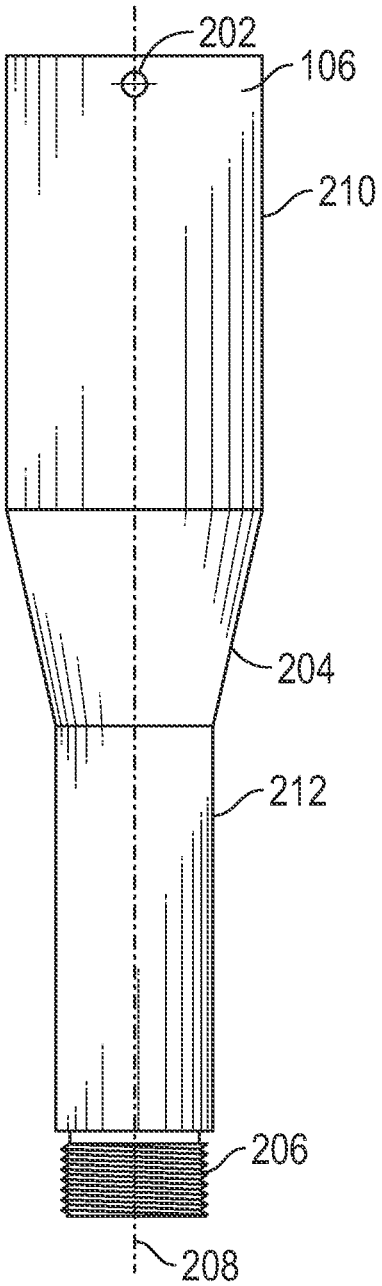
FIGS. 2A, 2B, and 2C depict several views of an example main body of a plug assembly according to some embodiments.
Figure 2B:
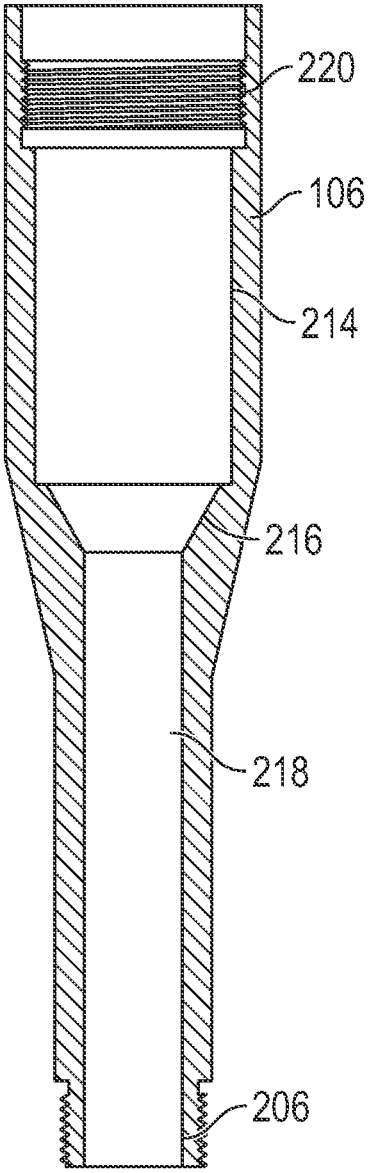
Figure 2C:
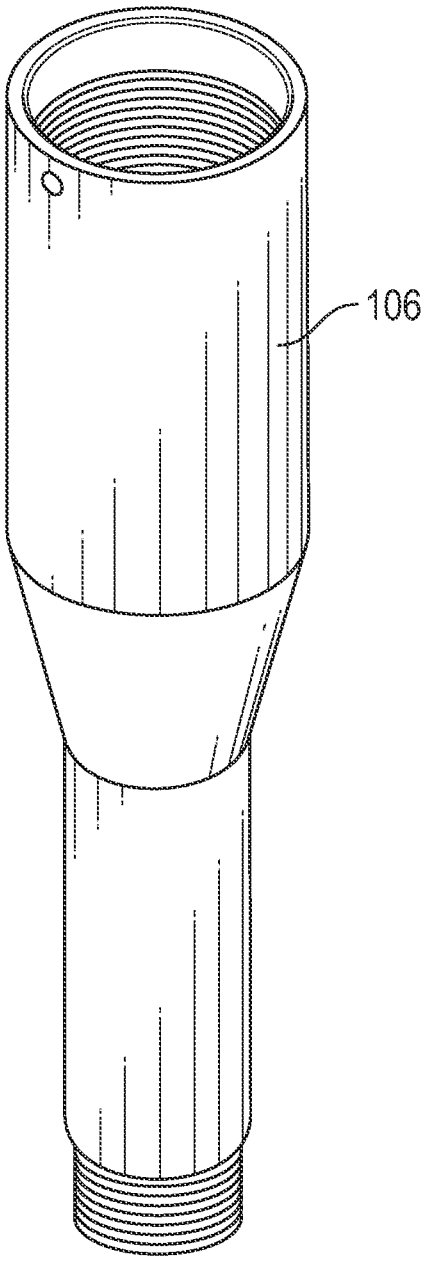

FIGS. 2A-C depict several views of an example main body of a plug assembly according to some embodiments. FIG. 2A shows an external view of the first mandrel or main body 106. Main body 106 can comprise a substantially cylindrical body along longitudinal axis 208.

Example main body 106 can include a first cylindrical section 210 and a second cylindrical section 212, the second cylindrical section 212 having a smaller outside diameter than that of first cylindrical section 210. Example main body 106*a* can further include a tapered section 204 between cylindrical sections 210 and 212. For example, tapered section 204 according to some embodiments may have a taper angle of between eight and eleven degrees.

Example main body 106 can further include a tapped hole 202. Main body 106 can also include threads 206 for coupling to other elements. For example, threads 206 may include buttress threads.

FIG. 2B depicts a cross-section view of the example main body 106 of FIG. 2A, across axis 208. Example main body 106 can include threads 206 and 220 for coupling with other elements. One of ordinary skill in the art will recognize that other methods of coupling may be suitable.

Example main body 106 can have two internal cylindrical sections 214 and 218, where the internal diameter at section 214 is larger than that of section 218. Example main body 106 can further include an internal taper section 216 between internal cylindrical sections 214 and 218.

FIG. 2C depicts an isometric external view of the example main body 106 of FIG. 2A, as described in detail above.

Figure 3A:
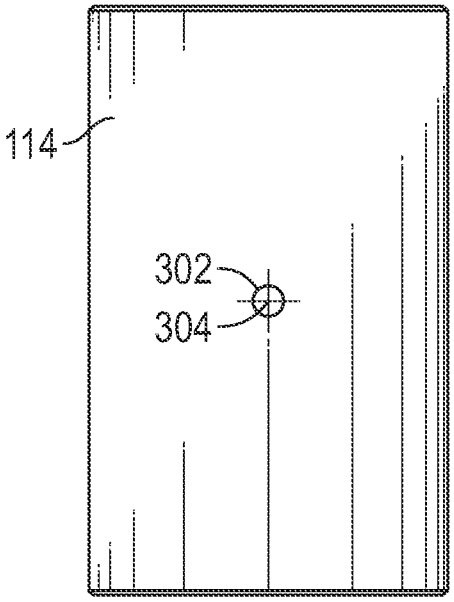
FIGS. 3A, 3B, and 3C depict several views of an example shear sleeve and shear pin of a plug assembly according to some embodiments.
Figure 3B:
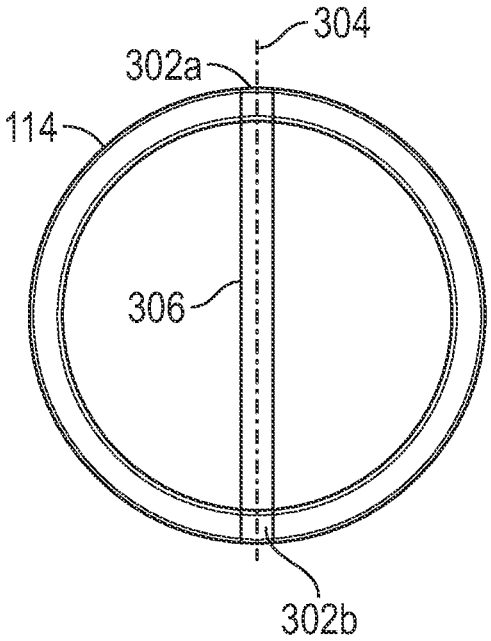
Figure 3C:
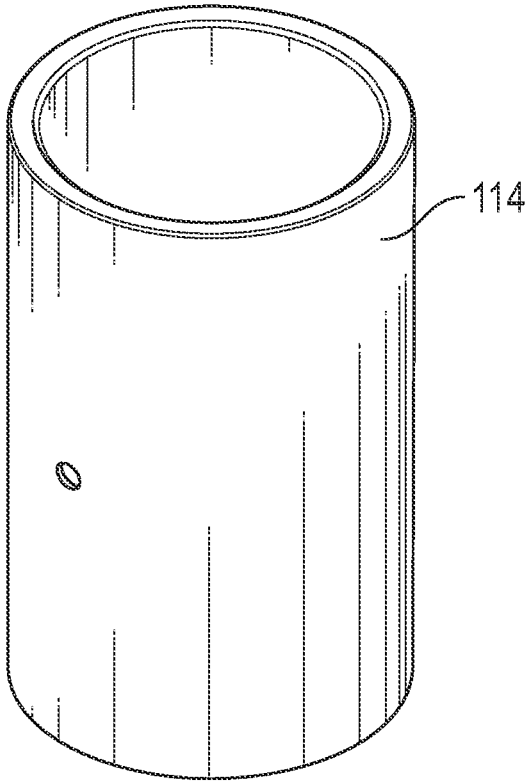

FIGS. 3A-C depicts several views of an example shear sleeve and shear pin of a plug assembly according to some embodiments. As shown in FIG. 3A, example shear sleeve 114 can be a substantially cylindrical body.

Example shear sleeve 114 can have a first opening 302 through its cylindrical wall and a second opening directly opposite, the second opening substantially similar to the first. In some embodiments, openings 302 can be approximately one eighth of an inch, for example to accommodate a common size of shear pin stock well known in the industry. One of ordinary skill in the art will understand that these features and dimensions are merely illustrative examples, and various specific configurations are possible.

FIG. 3B shows a top view of example shear sleeve 114, including example shear pin 306. Example shear pin 306 at FIG. 3B intact, before full deployment of an example plug tool according to various embodiments of the present invention. Example shear pin 306 may be any of a variety of materials. For example, example shear pin 306 may be constructed of aluminum, brass, or steel. One of ordinary skill in the art will recognize that numerous other materials having varying shear strengths are possible, depending on the application.

When a plug tool is assembled according to the present invention, a shear pin 306 can be selected for each section of the modular tool to be deployed. If control over the order of engagement of sections is desired, shear pins of varying materials can be selected. The order of engagement can then be set by assigning the shear pin having the weakest strength to the first section to be engaged, the second-weakest shear pin to the second section to be engaged, and so on. This arrangement can allow a level of control in deploying the wellbore plug that is often reserved for expensive e-line tools.

For additional reference, FIG. 3A defines axis 304 through opening 302 of FIG. 3A, which is the same axis as reference 304 of FIG. 3B, which runs through openings 302*a* and 302*b*.

FIG. 3C depicts an isometric external view of the example shear sleeve 114 according to some embodiments.

Figure 4A:
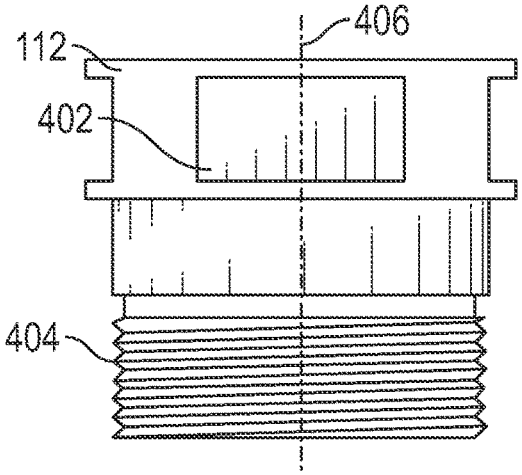
FIGS. 4A, 4B, and 4C depict several views of an example collar element 112 of a plug assembly according to some embodiments.
Figure 4B:
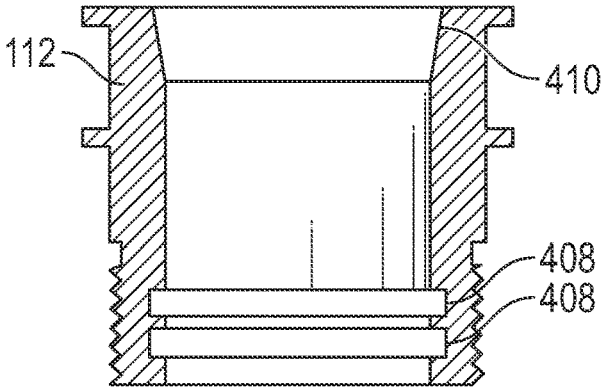
Figure 4C:
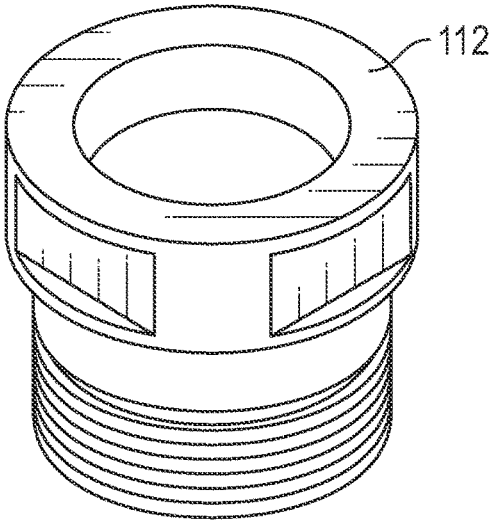

FIGS. 4A-C depict several views of an example collar element of a plug assembly according to some embodiments. As shown in FIG. 4A, collar element 112 (also called a seal catch) can be a substantially cylindrical body.

Collar element 112 can include flattened areas 402 at one (in this example, the top) end. These flattened areas (or "wrench flats") may aid in removing example collar element 112 from another element.

Example collar element 112 can also include threads 404 for coupling collar element 112 to other elements. For example, threads 404 may be buttress threads or another suitable type of thread. In other embodiments, threads 404 may be replaced by another coupling method as one of ordinary skill in the art would understand.

FIG. 4A additionally defines axis 406, along which FIG. 4B provides a cross-sectional view of example collar element 112. FIG. 4B reveals a tapered internal section 410, for example for engaging a tapered section of a mandrel 106. Additionally, example collar element 112 can include one or more internal collar elements 408.

FIG. 4C depicts an isometric external view of the example collar element 112 according to various embodiments, and as described in detail elsewhere herein.

Figure 5A:
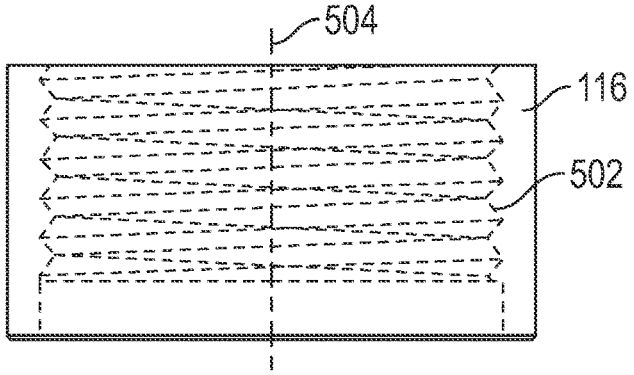
FIGS. 5A, 5B, and 5C depict several views of an example mandrel stop element of a plug assembly according to some embodiments.
Figure 5B:
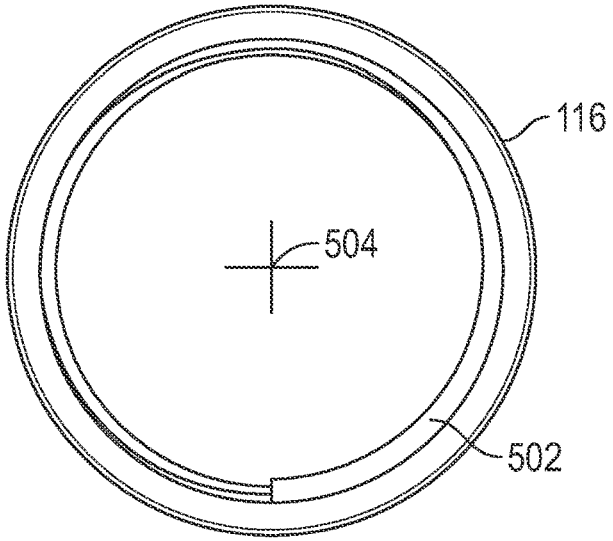
Figure 5C:
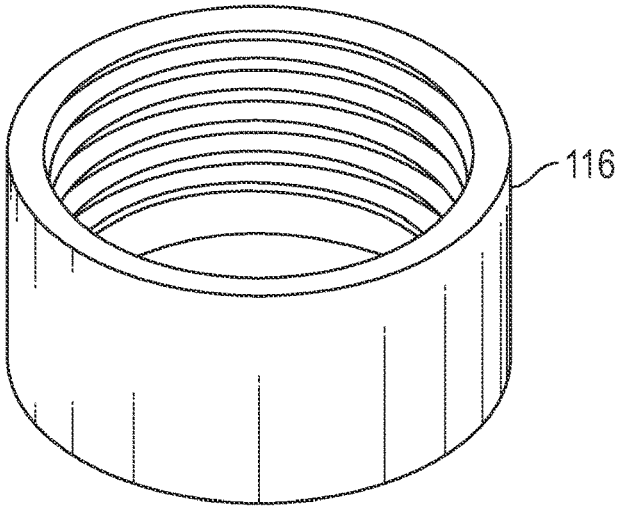

FIGS. 5A-C depict several views of an example mandrel stop element of a plug assembly according to some embodiments. As depicted at FIG. 5A, example mandrel stop element 116 (also called a "shear catch") can be a substantially cylindrical element.

In the example of FIG. 5A, example mandrel stop element 116 has a constant outside diameter. Example mandrel stop element 116 can further include internal threads 502 for coupling to other elements, in particular to the end of the first mandrel 106 as shown in FIG. 1. Internal threads 502 of example mandrel stop element 116 can be buttress threads, or any other suitable type of thread. In other embodiments, internal threads 502 can be replaced by another system of coupling, as one of ordinary skill in the art would understand.

FIG. 5B shows a top view of example mandrel stop element 116. FIG. 5B includes a top view of internal threads 502 as described above. For additional reference, FIG. 5A defines longitudinal axis 504, which is cross-referenced at FIG. 5B.

FIG. 5C depicts an isometric external view of the example mandrel stop element 116 according to various embodiments, and as described in detail elsewhere herein.

Figure 6A:
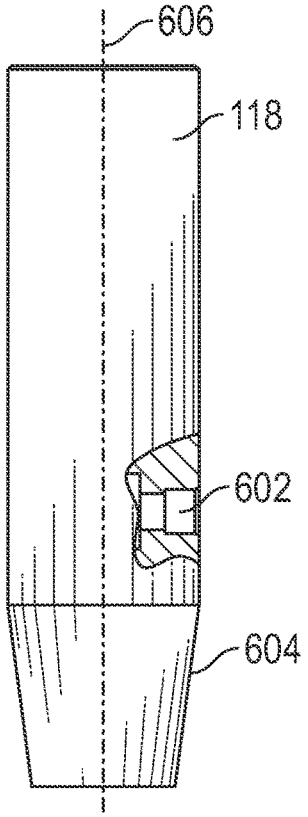
FIGS. 6A, 6B, 6C, and 6D depict several views of an example bottom rece1vmg element of a plug assembly according to some embodiments.

FIGS. 6A-D depicts several views of an example bottom receiving element of a plug assembly according to some embodiments. As shown in FIG. 6A, example bottom receiving element 118 can be a substantially cylindrical element externally. Example bottom receiving element can further include a tapered external section 604.

Example bottom receiving element 118 can further include a knockout plug 602. Knockout plug 602 may be, for example, a common part in the industry such as a standard Kobe knockout. In an example system, a knockout plug is used to equalize pressure between chambers previously sealed by the example plug tool. A slickline or other tool can break the knockout plug, thus allowing pressure to equalize and rendering the situation safe to attempt retrieval of a wellbore plug tool. One of ordinary skill in the art will realize many types of knockouts are possible depending on the specific application and availability.

Figure 6B:
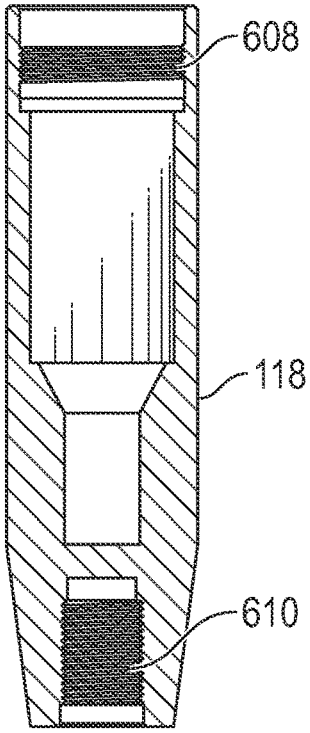

FIG. 6A additionally defines axis 606, along which FIG. 6B provides a cross-sectional view of example bottom receiving element 118. In the example of FIG. 6B, bottom receiving element 118 includes internal dimensions to accommodate a shear sleeve 114 and partial mandrel 106 as described elsewhere herein.

In the example of FIG. 6B, bottom receiving element 118 additionally includes internal threading 608 for coupling to other elements and in particular a collar element 112. Example bottom receiving element 118 can additionally include internal threads 610 for coupling to other elements such as other devices in a wellbore.

Figure 6C:
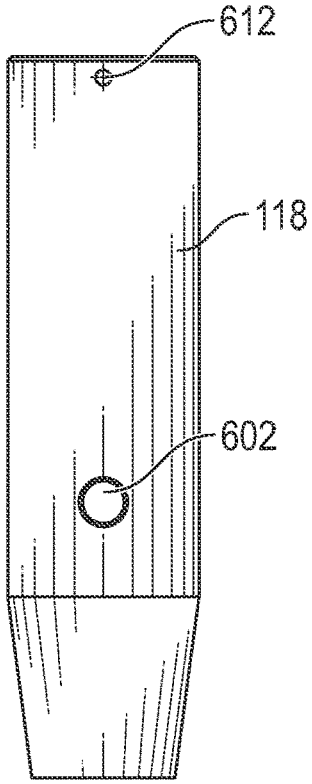

As shown in FIG. 6C, example bottom receiving element 118 can include a tapped hole 612 in addition to knockout plug 602.

Figure 6D:
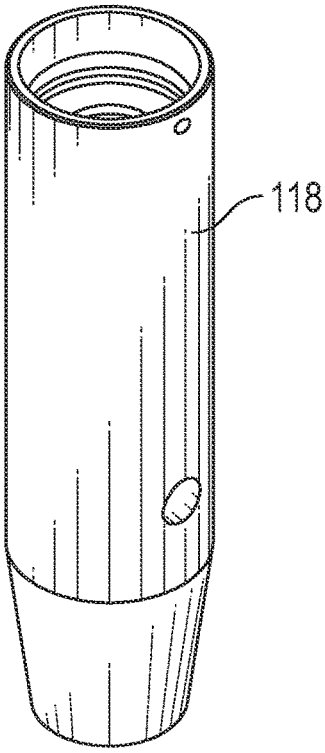

FIG. 6D depicts an isometric external view of the example bottom receiving element 118 according to various embodiments, and as described in detail elsewhere herein.

Figure 7A:
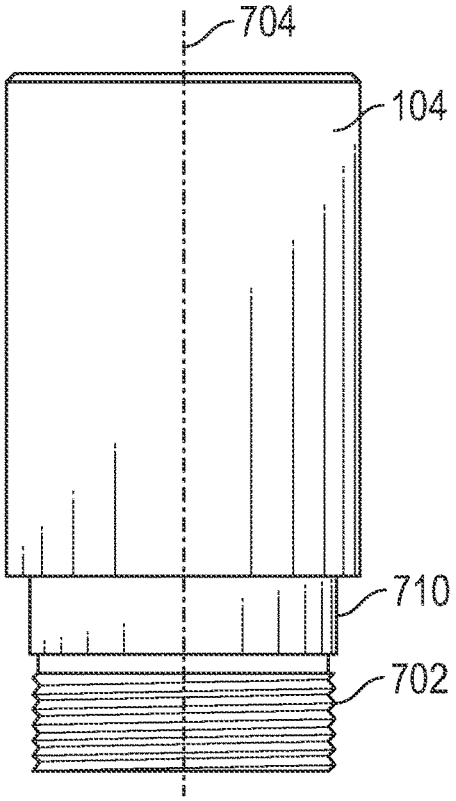
FIGS. 7A, 7B, and 7C depict several views of an example top catch body of a plug assembly according to some embodiments.
Figure 7B:
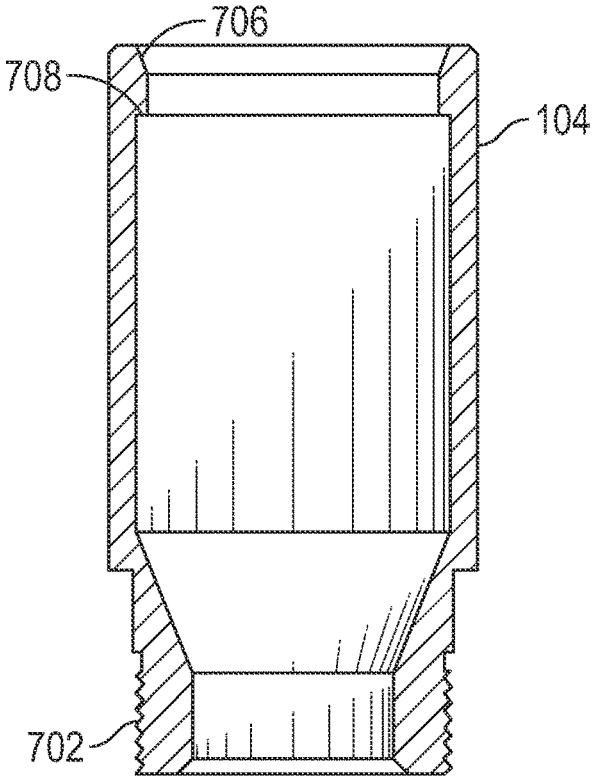
Figure 7C:
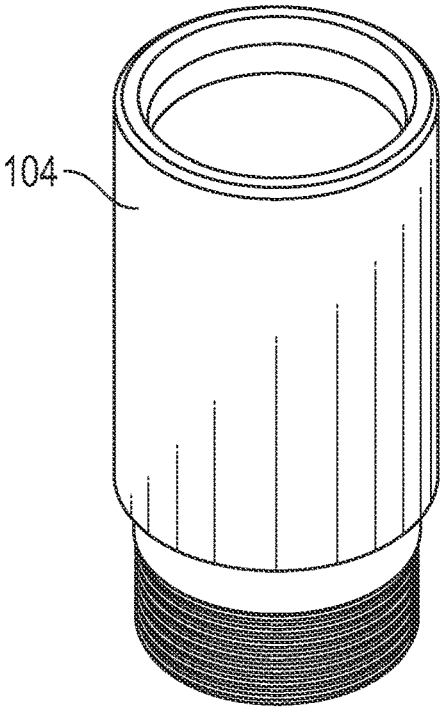

FIGS. 7A-C depicts several views of an example top catch body of a plug assembly according to some embodiments. Top catch body 104 (also called a "fishing neck") according to various embodiments can be a standard element used for retrieving plugs or tools from wellbore.

As shown in FIG. 7A, top catch body 104 can be externally substantially cylindrical. Example top catch body 104 can include a second cylindrical section 710 having a diameter smaller diameter than the main cylindrical body of example top catch body 104.

Example top catch body 104 can further include threads 702 for coupling with other elements, and in particular the top of an example main body or mandrel 106, as described elsewhere herein. In other embodiments, threads 702 may be replaced by another coupling method as one of ordinary skill in the art would understand.

FIG. 7A additionally defines axis 704, along which FIG. 7B provides a cross-sectional view of example top catch body 104. In the example of FIG. 7B, example top catch body 104 can include internal tapered section 706 and collar section 708 for interfacing with tools for placement and retrieval of a plug assembly in wellbores.

FIG. 7C depicts an isometric external view of the example top catch body 104 according to various embodiments, and as described in detail elsewhere herein.

Illustrative Processes

Figure 8:
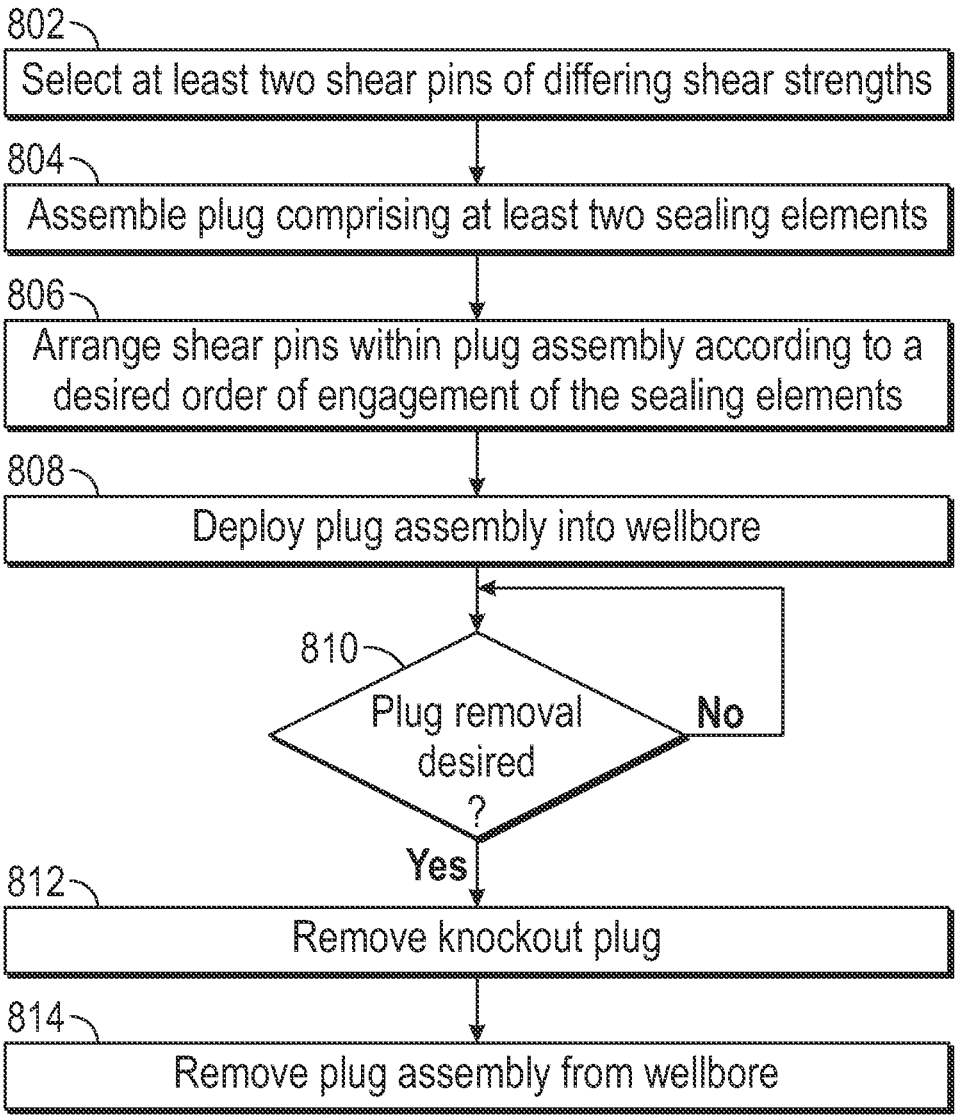
FIG. 8 is a flow chart of an example process for assembling, deploying, and retrieving a multi-barrier plug assembly according to some embodiments.

FIG. 8 is a flow chart of an example process for assembling, deploying, and retrieving a multi-barrier plug assembly according to some embodiments. In various embodiments, the methods of FIG. 8 may be performed by a human or humans, by a machine or machines, or a combination of humans and machines.

At step 802, at least two shear pins of different shear strengths are selected. As discussed elsewhere herein, the order of engaging each seal or barrier in a multi-barrier plug assembly is determined by placement and relative shear strength of the shear pins selected.

At step 804, a plug tool assembly is assembled including at least two sealing elements. For example, a plug tool may be assembled using example configurations as shown in FIGS. 1A and 1C and description thereof.

At step 806, the shear pins are arranged within the assembled plug tool according to a desired order of engagement of the sealing elements. For example, the shear pin having the weakest strength can be assigned to the first section to be engaged, the second-weakest shear pin to the second section to be engaged, and so on. This arrangement can allow a level of control in deploying the wellbore plug that is often reserved for expensive e-line tools.

At step 808, the plug tool assembly is physically deployed into a wellbore. For example, standard slickline deployment tools may be used at step 808. In other embodiments, other standard deployment methods may be used, as one of ordinary skill in the art would understand. Full deployment of the plug tool assembly in this example includes applying appropriate pressure to break each of the shear pins in the order prescribed at step 806.

At step 810, a determination is made whether removal of the plug tool assembly from the wellbore is desired. If plug tool removal is not desired, this condition can be periodically re-evaluated.

If plug tool removal is desired, control proceeds to step 812.

At step 812, the knockout plug is removed. In the example case of a standard Kobe knockout, the knockout plug may be removed by, for example, beating and breaking the knockout plug with slickline. One of ordinary skill in the art will recognize it would be possible to use a wide variety of knockout plugs and similar devices are possible, and the specific method of removing or breaking the knockout plug will depend on the particular application and equipment used.

Finally, at step 814, the example plug tool assembly is removed from the wellbore by appropriate means. For example, a slickline removal tool may be used in some embodiments.

CONCLUSION

Although the techniques and devices have been described in language specific to structural features and/or methodological acts, it is to be understood that the appended claims are not necessarily limited to the features or acts described. Rather, the features and acts are described as example implementations of such techniques and devices.

Conditional language such as, among others, "can," "could," "might" or "may," unless specifically stated otherwise, are understood within the context to present that certain embodiments include, while other embodiments do not include, certain features, elements and/or steps. Thus, such conditional language is not generally intended to imply that certain features, elements and/or steps are in any way required for one or more embodiments or that one or more embodiments necessarily include logic for deciding, with or without user input or prompting, whether certain features, elements and/or steps are included or are to be performed in any particular embodiment.

Conjunctive language such as the phrase "at least one of X, Y or Z," unless specifically stated otherwise, is to be understood to present that an item, term, etc. can be either X, Y, or Z, or a combination thereof.

Any routine descriptions, elements or blocks in the flow charts described herein and/or depicted in the attached figures should be understood as potentially representing modules, segments, or portions of code that include one or more executable instructions for implementing specific logical functions or elements m the routine. Alternate implementations are included within the scope of the embodiments described herein in which elements or functions can be deleted, or executed out of order from that shown or discussed, including substantially synchronously or in reverse order, depending on the functionality involved as would be understood by those skilled in the art.

It should be emphasized that many variations and modifications can be made to the above-described embodiments, the elements of which are to be understood as being among other acceptable examples. All such modifications and variations are intended to be included herein within the scope of this disclosure and protected by the following claims.

What is claimed is:

1. A device, comprising:

a main body having a top end and a bottom end along a longitudinal axis, the main body including a first diameter adjacent the top end and a second diameter adjacent the bottom end;

a receiving body receiving a portion of the main body; and a plurality of coupling elements including at least one shear sleeve disposed radially between the main body and the receiving body, wherein the portion of the main body disposed within the receiving body is radially and fully enclosed with the plurality of coupling elements, wherein the at least one shear sleeve is coupled with a shear pin such that the shear pin is disposed within the receiving body transversely in the longitudinal axis.

2. The device of claim 1, wherein the plurality of coupling elements further include at least one collar element disposed radially between the main body and the receiving body.

3. The device of claim 2, wherein the shear sleeve has a cylindrical wall formed with openings to receive the shear pin such that the shear pin is coupled with the openings of the shear sleeve.

4. The device of claim 2, wherein at least one sealing element, the at least one collar element, and the at least one shear sleeve are radially disposed about the main body and each arranged in an order along the longitudinal axis.

5. The device of claim 1, wherein the device further includes at least one sealing element disposed about the main body.

6. The device of claim 1, further comprising a mandrel stop element coupled to the bottom end of the main body.

7. The device of claim 1, further comprising a top catch body coupled to the top end of the main body.

8. The device of claim 1, wherein the first diameter of the main body is larger than the second diameter such that the main body is formed with a tapered section between the first diameter and the second diameter.

9. A device, comprising:

a bottom receiving body;

a first mandrel assembly comprising:

a first main body having a top end and a bottom end, the first main body partially disposed within the bottom receiving body;

a plurality of first coupling elements including a first collar element and a first shear sleeve disposed radially between the first main body and the bottom receiving body such that a portion of the first main body disposed within the bottom receiving body is fully enclosed with the plurality of first coupling elements; and the device further comprises:

a second mandrel assembly comprising:

a second main body having a top end and a bottom end, the second main body partially disposed within the first main body; and a plurality of second coupling elements including a second collar element and a second shear sleeve disposed radially between the first main body and the second main body such that a portion of the second main body disposed within the first main body is fully enclosed with the plurality of second coupling elements.

10. The device of claim 9, wherein:

a first shear pin is disposed within the first shear sleeve, the first shear sleeve at least partially disposed within the bottom receiving body; and a second shear pin is disposed within the second shear sleeve, the second shear sleeve at least partially disposed within the first main body.

11. The device of claim 9, further comprising:

a first sealing element disposed about the first main body; and a second sealing element disposed about the second main body.

12. The device of claim 11, further comprising at least one back-up ring that is in contact with the first or second sealing element.

13. The device of claim 9, further comprising:

a first mandrel stop element coupled to the bottom end of the first main body, and a second mandrel stop element coupled to the bottom end of the second main body.

14. The device of claim 9, further comprising a third mandrel assembly having:

a third main body comprising a top end and a bottom end, the third main body is at least partially disposed within the second main body;

a third sealing element disposed about the third main body; and a third shear pin disposed within the second main body.

15. The device of claim 9, further comprising a top catch body coupled to the top end of the second main body.

16. The device of claim 9, wherein the bottom receiving body further comprises a knockout plug.

17. A method, comprising:

selecting at least two shear pins according to a desired order of engagement of at least two mandrels;

assembling a plug assembly comprising the at least two mandrels positioned from a top to a bottom of the plug assembly along a longitudinal axis and a bottom receiving body, each mandrel comprises one of the shear pins and a sealing element, one of the mandrels arranged in a higher position than the other mandrel along the longitudinal axis is at least partially disposed within the other mandrel, one of the mandrels arranged in the bottom is at least partially disposed within the bottom receiving body;

deploying the plug assembly into a wellbore; and applying pressure continuously until each of the shear pins coupled to each of the mandrels shear, wherein the plug assembly further comprises a top catch body coupled to one of the mandrels disposed in the top of the plug assembly.

18. The method of claim 17, further comprising the step of removing the plug assembly from the wellbore using the top catch body.

* * * * *